US009142177B2

(12) United States Patent
Ichimasa

(10) Patent No.: US 9,142,177 B2
(45) Date of Patent: Sep. 22, 2015

(54) ELECTROOPTICAL DISPLAY APPARATUS THAT PERFORMS VOLTAGE SAMPLING OUTSIDE OF A NOISE SETTLING PERIOD, AND ELECTRONIC DEVICE

(71) Applicant: CANON KABUSHIKI KAISHA, Tokyo (JP)

(72) Inventor: Shoji Ichimasa, Utsunomiya (JP)

(73) Assignee: CANON KABUSHIKI KAISHA (JP)

( * ) Notice: Subject to any disclaimer, the term of this patent is extended or adjusted under 35 U.S.C. 154(b) by 307 days.

(21) Appl. No.: 13/677,568

(22) Filed: Nov. 15, 2012

(65) Prior Publication Data

US 2013/0120350 A1 May 16, 2013

(30) Foreign Application Priority Data

Nov. 16, 2011 (JP) ..... 2011-250453

(51) Int. Cl.
*G09G 3/36* (2006.01)

(52) U.S. Cl.
CPC ..... *G09G 3/3648* (2013.01); *G09G 3/3685* (2013.01); *G09G 2310/027* (2013.01)

(58) Field of Classification Search
CPC ..... G09G 2310/08; G09G 3/3685
USPC ..... 345/100, 99
See application file for complete search history.

(56) References Cited

U.S. PATENT DOCUMENTS

| | | | | |
|---|---|---|---|---|
| 6,160,533 | A | 12/2000 | Tamai et al. | |
| 2003/0128199 | A1 * | 7/2003 | Kimura | 345/204 |
| 2004/0056854 | A1 * | 3/2004 | Kondo et al. | 345/204 |
| 2007/0057890 | A1 * | 3/2007 | Ayel et al. | 345/94 |

FOREIGN PATENT DOCUMENTS

| | | | |
|---|---|---|---|
| JP | 09-068692 | A | 3/1997 |
| JP | 2008-170843 | * | 7/2008 |
| JP | 2008-170843 | A | 7/2008 |

* cited by examiner

*Primary Examiner* — Roy Rabindranath
(74) *Attorney, Agent, or Firm* — Rossi, Kimms & McDowell LLP

(57) ABSTRACT

The electrooptical display apparatus includes pixels, and scan lines and data lines arranged in a matrix. The apparatus further includes pixel switching elements each enabling, in response to application of a selection voltage to one scan line, application of a pixel voltage to one pixel in a pixel row corresponding to the one scan line through one data line, a voltage producing part producing a sampling voltage that is to be supplied to the data lines and that monotonously changes while the selection voltage is applied to the scan line, a voltage sampling part sampling the pixel voltage from the sampling voltage, a sampling number detecting part detecting number of pixels for which a same voltage is sampled, and a controller lowering a frequency of sampling of the pixel voltage when the detected number is a predetermined number.

9 Claims, 10 Drawing Sheets

ELECTROOPTICAL DISPLAY APPARATUS THAT PERFORMS VOLTAGE SAMPLING OUTSIDE OF A NOISE SETTLING PERIOD, AND ELECTRONIC DEVICE

BACKGROUND OF THE INVENTION

1. Field of the Invention

The present invention relates to an electrooptical display apparatus such as a liquid crystal display apparatus that displays images by electrooptical change.

2. Description of the Related Art

A drive circuit of such an electrooptical display apparatus is disclosed in Japanese Patent No. 3367808 which, in a period of time where a selection voltage is applied to a scan line, maintains a voltage applied to a common electrode constant and applies a signal (pixel voltage) that monotonously changes to a pixel electrode through a switch turned on and a data line. The drive circuit turns the switch off after elapse of a time corresponding to a target gradation (input gradation) to holds a voltage difference between the pixel electrode and the common electrode.

However, when using the drive circuit disclosed in Japanese Patent No. 3367808, if the pixel voltage does not monotonously change according to its setting for some reason, the voltage difference between the pixel electrode and the common electrode corresponding to the target gradation cannot be obtained, which makes it impossible to display the target gradation and thereby deteriorates image display quality.

As a countermeasure for such a problem, Japanese Patent Laid-Open No. 2008-170843 discloses a drive circuit that absorbs noise generated in the pixel voltage, which should monotonously change, due to variation of load (capacitance) during application of the pixel voltage. This drive circuit connects a load different from the load during the application of the pixel voltage to a voltage supply line or a common electrode in response to the load variation, and thereby suppresses the variation of the load, that is, variation of the pixel voltage, which prevents the reduction of the image display quality.

However, when using the drive circuit disclosed in Japanese Patent Laid-Open No. 2008-170843, if the load connected to the voltage supply line or the common electrode in order to suppress the load variation (pixel voltage variation) is an external load, a sufficient effect cannot be obtained for the load variation generated inside the electrooptical display apparatus.

Moreover, when using an internal load as the load connected to the voltage supply line or the common electrode, a large load variation makes it difficult to provide, in the electrooptical display apparatus, the internal load that can reduce the load variation.

SUMMARY OF THE INVENTION

The present invention provides an electrooptical display apparatus capable of preventing the deterioration of the image display quality more effectively than conventional ones with a simpler configuration than the conventional ones.

The present invention provides as one aspect thereof an electrooptical display apparatus including a plurality of pixels, and scan lines and data lines arranged in a matrix. The apparatus further includes pixel switching elements each configured to enable, in response to application of a selection voltage to one of the scan lines, application of a pixel voltage to one pixel included in a pixel row corresponding to the one scan line through one of the data lines, a voltage producing part configured to produce a sampling voltage that is allowed to be supplied to the data lines and that monotonously changes in a period of time where the selection voltage is applied to the scan line, a voltage sampling part configured to sample the pixel voltage from the sampling voltage with a configuration including a scan line drive circuit to apply the selection voltage to a sequentially selected one of the scan lines and data line switches to switch on and off of supply of the sampling voltage to the data lines, a sampling number detecting part configured to detect a same voltage sampling number that is number of pixels for which a same voltage is sampled as the pixel voltage by the voltage sampling part, and a controller configured to lower a frequency of sampling of the pixel voltage in a case where the same voltage sampling number detected by the sampling number detecting part is a predetermined number.

The present invention provides as another aspect thereof an electronic device including a body of the device, and the above-mentioned electrooptical display apparatus attached to the body.

Further features of the present invention will become apparent from the following description of exemplary embodiments (with reference to the attached drawings).

DESCRIPTION OF THE PREFERRED EMBODIMENTS

Exemplary embodiments of the present invention will hereinafter be described with reference to the accompanying drawings.

Embodiment 1

Figure 1:
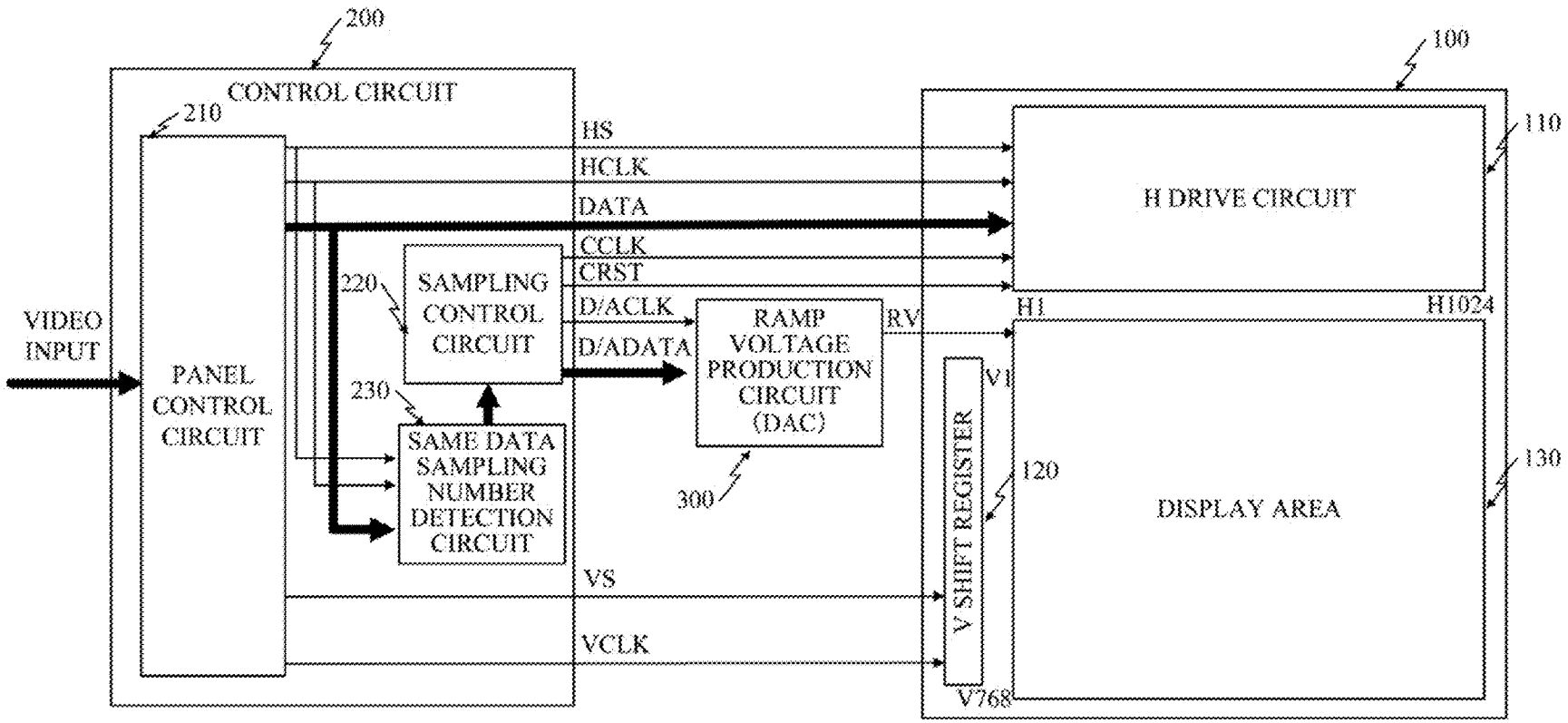
FIG. 1 is a block diagram showing a configuration of an electrooptical display apparatus that is Embodiment 1 of the present invention.

FIG. 1 shows a configuration of an electrooptical display apparatus that a first embodiment (Embodiment 1) of the present invention. The electrooptical display apparatus is constituted by a liquid crystal display panel 100 as a displaying part, a control circuit 200 and a ramp voltage production circuit 300 as a voltage producing part. The liquid crystal display panel 100 displays images in its display area 130 including a plurality of pixels (horizontal 1024 pixels×vertical 768 pixels for an XGA resolution in this embodiment).

The electrooptical display apparatus of this embodiment can be provided in various electronic devices such as liquid crystal projectors, liquid crystal televisions, cellular phones, laptop computers, digital still and video cameras and car navigation devices.

In the control circuit 200, a panel control circuit 210 receives a digital input video from an external apparatus (not shown) and produces a drive control signal to the liquid crystal display panel 100. A same data sampling number detection circuit 230 as a sampling number detecting part detects, from video data subjected to various correction processes such as gamma correction and color unevenness correction at the panel control circuit 210, number of pixels for which same gradation data (hereinafter simply referred to as "same data") is set. The number of pixels for which the same data is set is hereinafter referred to as "a same data sampling number".

A sampling control circuit 220 as a controlling part controls a voltage production operation of the ramp voltage production circuit 300 and drive of the liquid crystal display panel 100 according to the same data sampling number (detection result) detected by the same data sampling number detection circuit 230.

The liquid crystal display panel 100 is provided thereinside with the display area 130, a horizontal (H) drive circuit 110, a vertical (V) shift register 120 as a scan lines drive circuit. The H drive circuit 110 receives the drive control signal and the video data from the panel control circuit 210 and another drive control signal from the sampling control circuit 220 to drive pixels of each of horizontal pixel rows included in the display area 130. The horizontal pixel row is hereinafter referred to as "a pixel line".

Figure 2:
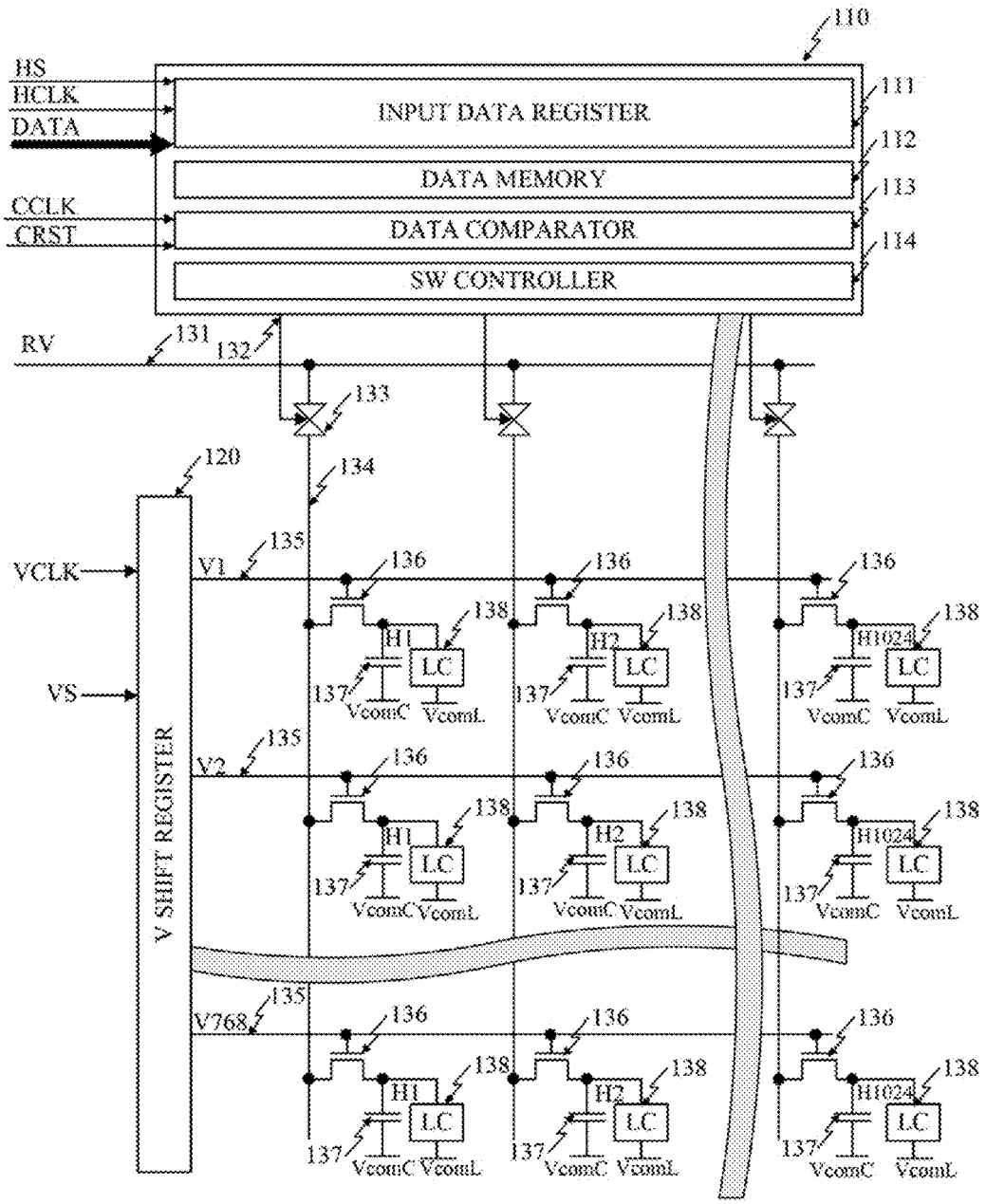
FIG. 2 shows a configuration of a liquid crystal display panel in the electrooptical display apparatus of Embodiment 1.

As shown in FIG. 2, an input data register 111 in the H drive circuit 110 sequentially receives the video data subjected to the various correction processes such as the gamma control and the color unevenness correction in the panel control circuit 210 to store the video data for N+1 pixel lines.

A data memory 112 in the H drive circuit 110 stores video data for an N pixel line among the video data received by the input data register 111. A data comparator 113 compares the video data stored in the data memory 112 with a value of a counter clock (sampling clock) CCLK input to the data comparator 113.

A switch (SW) controller 114 converts, on a basis of output from the data comparator 113, a switch (SW) signal 132 for switching an analog switch 133 as a data line switch into a voltage that can turn the analog switch 133 on and off, and outputs the voltage.

The ramp voltage production circuit 300 produces a ramp voltage (RV) 131 as a sampling voltage to be supplied to video lines 134. The analog switch 133 turns on and off supply of the ramp voltage (RV) 131 to the video lines 134 as data lines arranged in the display area 130 so as to extend in a vertical direction. In the XGA resolution, 1024 video lines 134 are included in the display area 130, and the analog SW 133 is provided for each video line 134.

The V shift register 120 receives a VS signal and a VCLK signal from the panel control circuit 210 to control output of a V scan signal (selection voltage) to horizontal scan lines 135 arranged so as to extend in a horizontal direction in the display area 130. In the XGA resolution, 768 horizontal scan lines 134 are included in the display area 130. Although a detailed description will be made later, the ramp voltage (RV) 131 is produced, in a period of time where the V scan signal is applied to one of the horizontal scan lines 135, so as to monotonously change (monotonously increase). The V shift register 120 and the analog switches 133 constitute a voltage sampling part.

The horizontal scan lines 135 and the video lines 134 are arranged in a matrix. At each portion where the horizontal scan lines 135 intersect with the video lines 134, a pixel transistor 136 as a pixel switching element, a pixel capacitor 137 and a liquid crystal (LC) 138 are provided. The pixel transistor 136, the pixel capacitor 137 and the liquid crystal (LC) 138 constitute one pixel.

The ramp voltage (RV) 131 to be supplied to the video line 134 through the analog switch 133 is connected to a drain of the pixel transistor 136. A gate of the pixel transistor 136 is connected to the horizontal scan line 135. Thus, turning on and off of the pixel transistor 136 is controlled by the V scan signal from the horizontal scan line 135.

One end of the pixel capacitor 137 is connected to a source of the pixel transistor 136, and receives the ramp voltage applied to the video line 134 to charge the ramp voltage as a liquid crystal driving voltage (pixel voltage). The video line 134 is connected to the source of the pixel transistor 136. The video line 134 itself as a wiring serves as a capacitance of a capacitor, and provides a capacitance larger (hundreds to tens of thousands of times larger) than a capacitance of the pixel capacitor 137. Moreover, another end of the pixel capacitor 137 is connected to a predetermined voltage VcomC.

The liquid crystal (LC) 138 is driven according to a potential difference between the liquid crystal driving voltage (pixel voltage) that is charged in the pixel capacitor 137 and applied to a pixel electrode (not shown) and a predetermined voltage VcomL that is applied to a transparent electrode (not shown). The above-mentioned "same data" that means the same gradation data can be also said as "a same liquid crystal driving voltage".

Moreover, this embodiment describes a case of employing, as a liquid crystal drive method, a so-called normally black mode in which a nearly zero liquid crystal driving voltage minimizes light transmittance of the liquid crystal 138 to display black and the light transmittance increases as the liquid crystal driving voltage increases.

A detailed description will hereinafter be made of operations of the liquid crystal display panel 100 and the ramp voltage production circuit 300 with reference to FIGS. 1 and 2.

As described above, the panel control circuit 210 in the control circuit 200 receives the input video and performs thereon the various correction processes such as the gamma correction and the color unevenness correction to produce the video data. The produced video data is input to the H drive circuit 110 in the liquid crystal display panel 100 through a DATA line and to the same data sampling number detection circuit 230 in the control circuit 200.

Figure 8:
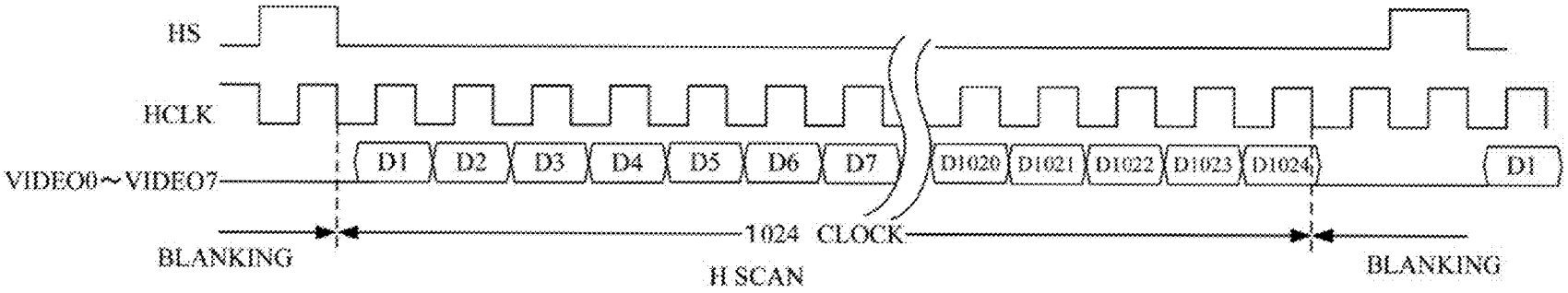
FIG. 8 is a timing chart showing horizontal scan timing.

The video data input to the H drive circuit 110 is stored in the input data register 111 in the H drive circuit 110 as shown in FIG. 8. The input data register 111 starts storing of the video data in response to input of a horizontal start signal HS output from the panel control circuit 210 and stores the video data as data D1 to D1024 in synchronization with a horizontal scan clock signal HCLK. In the XGA resolution, the H drive circuit 110 stores 1024 video data in the horizontal direction.

The data memory 112 stores the video data for the N pixel line received by the input data register 111. At this time, video data for an N+1 pixel line, which is a next pixel line, is input to the input data register 111.

Figure 9:
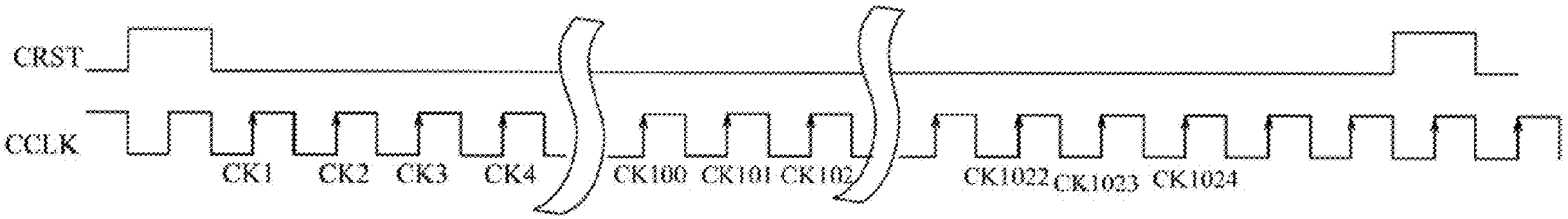
FIG. 9 is a timing chart showing operation of the ramp voltage producing circuit constituted by a D/A converter.

The data comparator 113 includes, as shown in FIG. 9, a counter that starts counting of the CCLK from input of a CRST signal output from the sampling control circuit 220. Then, the data comparator 113 compares a count value counted by the counter with the video data stored in the data memory 112.

For example, when the video data has a gradation number of 10 bits and the video data of D1 is 100, the data comparator 113 outputs a comparator signal to the SW controller 114 at CK100. Moreover, for example, when the video data of D2 is 4, the data comparator 113 outputs the comparator signal to the SW controller 114 at CK4. Thus, the data comparator 113 can output 1024 comparator signals in the horizontal direction.

The SW controller 114 converts the 1024 comparator signals from the data comparator 113 into voltages to output control signals to the 1024 analog switches 133. Turning on and off of the analog switches 133 controls application and cutoff of the ramp voltage (RV) 131 output from the ramp voltage production circuit 300 with respect to the video lines 134.

The 1024 analog switches 133 are all turned on by the CRST signal and thereby the ramp voltage (RV) 131 is applied to all the video lines 134. The analog switch 133 is turned off in response to reception of the comparator signal to cut off the application of the ramp signal (RV) to the video line.

Next, description will be made of production of the ramp voltage by the ramp voltage production circuit 300. The following description will be made of a case where the ramp voltage production circuit 300 is constituted by a D/A converter. The sampling control circuit 220 inputs, to the D/A converter constituting the ramp voltage production circuit 300, a signal D/ACLK that is a clock for updating data of the D/A converter and a signal D/ADATA that is data for instructing increment of the ramp voltage. The sampling control circuit 220 starts output of the D/ACLK and the D/ADATA from input of the CRST signal in synchronization with the CCLK.

Figures 4A, 4B, 4C:
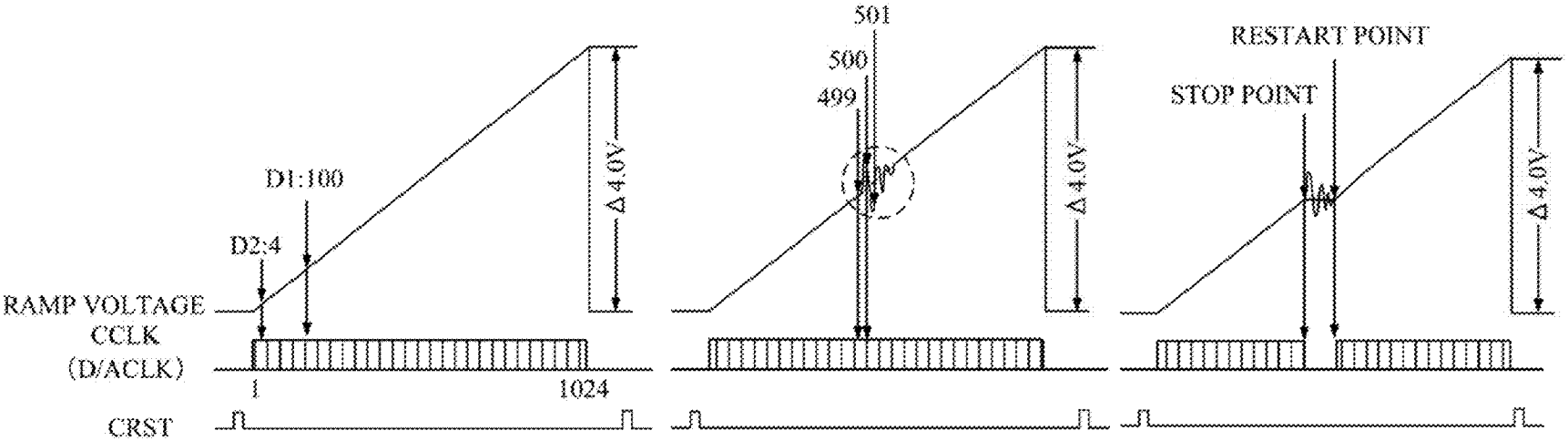
FIGS. 4A, 4B and 4C show a ramp voltage and variation thereof in the electrooptical display apparatus of Embodiment 1.

Moreover, the sampling control circuit 220 outputs the D/ADATA as data being incremented with a clock number of the D/ACLK. For example, the ramp voltage production circuit 300 corresponding to the gradation number of 10 bits produces a ramp waveform with a resolution of 1024. Thus, the D/A converter produces the ramp voltage that monotonously increases (monotonously changes) as shown in FIG. 4A.

The ramp voltage (RV) 131 output from the ramp voltage production circuit 300 is set to a predetermined start voltage (hereinafter referred to as "a ramp start voltage") at a time of input of the CRST signal, and, for example at D1, the ramp voltage (RV) 131 is increased to a voltage shown by "D1:100" in FIG. 4A to be applied to the video line 134. When the ramp voltage production circuit 300 corresponds to the gradation number of 10 bits (1024 resolution) as mentioned above and a maximum value of the ramp voltage (Δ voltage) is 4V, the voltage shown by "D1:100" is calculated as follows:

$$\{(100-1)/1024\}\times 4V=0.3867V.$$

That is, a voltage of +0.3867V with respect to the ramp start voltage is applied to the video line 134.

Moreover, for example, at D2, the ramp voltage (RV) 131 as a voltage shown by "D2:4" in FIG. 4A is applied to the video line 134. The voltage shown by "D2:4" is calculated as follows:

$$\{(4-1)/1024\}\times 4=0.0117V.$$

That is, a voltage of +0.0117V with respect to the ramp start voltage is applied to the video line 134.

Such sampling from the ramp voltage is performed, and thereby the sampled voltage (liquid crystal drive voltage) is applied to the 1024 video lines 134. The liquid crystal drive voltage applied to the video lines 134 is connected to the gates of the 1024 (H1 to H1024) pixel transistors 136 in one pixel line in response to the V scan signal output from the V shift register 120. As a result, the 1024 pixel transistors 136 are turned on.

The turning on of the pixel transistors 136 connects the video lines 134 with the pixel capacitors 137 through the pixel transistors 136, and thereby the liquid crystal drive voltage sampled from the ramp voltage is charged to the pixel capacitors 137. The liquid crystal drive voltage thus charged to each of the H1 to H1024 pixel capacitors 137 drives the liquid crystal 138 in each of the 1024 pixels.

The V shift register 120 receiving a vertical scan start signal VS and a vertical scan clock signal VCLK from the panel control circuit 210 sequentially vertically scans the V scan signal output to the horizontal scan lines 135 (that is, sequentially selects one of the horizontal scan lines 135 to which the V scan signal is supplied) from V1 to V768 at each clock of the VCLK. This scanning enables writing (charging) control of the liquid crystal drive voltage to all the pixels in the display area 130 of the liquid crystal display panel 100. Then, the liquid crystal 138 is driven according to a difference between the VcomL applied to the transparent electrode and the liquid crystal drive voltage applied to the pixel electrode, which displays an image in the display area 130.

Next, description will be made of an influence of noise generated in the sampling of the liquid crystal drive voltage from the ramp voltage (hereinafter referred to as "voltage sampling").

Figures 10A, 10B, 10C, 10D:
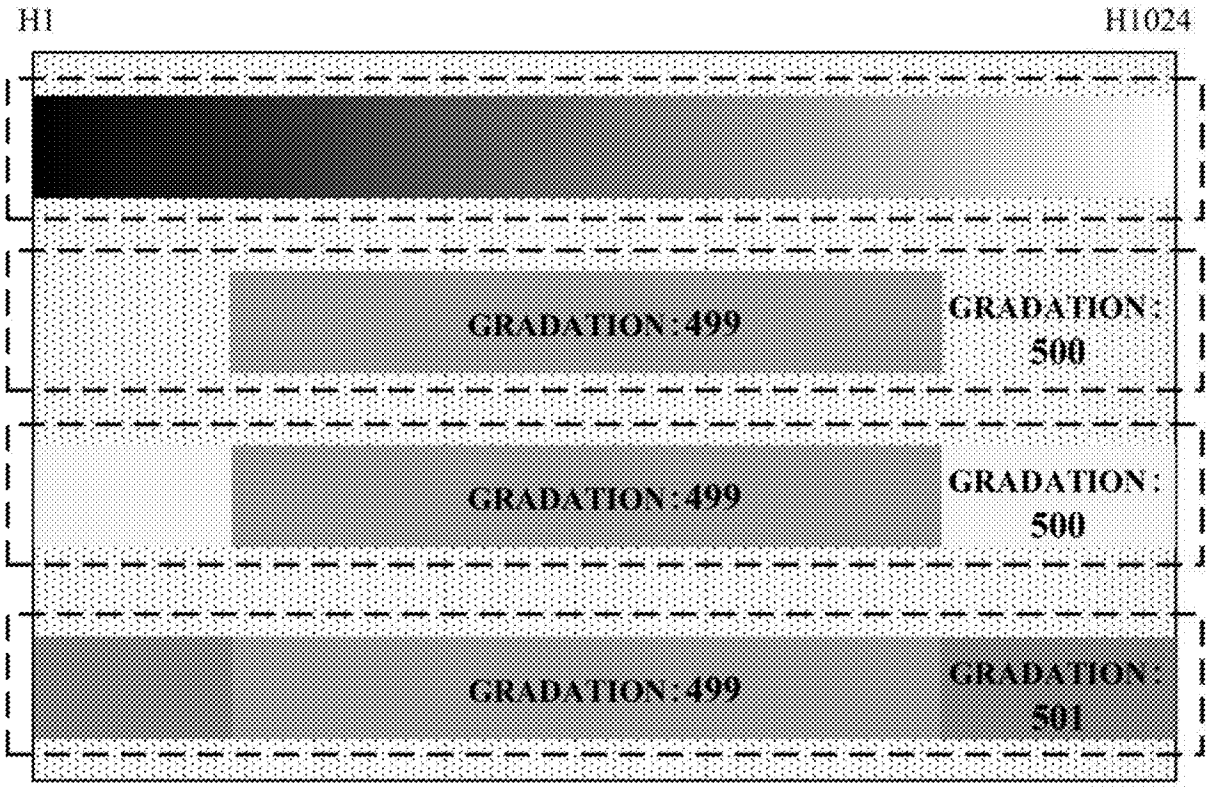
FIGS. 10A, 10B, 10C and 10D show examples of display in the electrooptical display apparatus.

FIGS. 10A to 10D show exemplary images (patterns) displayed in the display area 130. FIG. 10A shows a gradation pattern in which gradation gradually changes. In this embodiment driving the liquid crystal by the normally black mode, when such a gradation pattern is displayed, all the 1024 analog switches 133 are first turned on by the CRST signal, and thereby the ramp voltage (RV) 131 is supplied to all the 1024 video lines 134. Then, for example, when the video data (gradation data) for the pixel of H1 (H1 pixel) is 1 that is lowest data, the SW controller 114 turns off the analog switch 133 of H1 in response to the comparator signal output from the data comparator 113 at a first clock of the CCLK. As a result, as understood from the following calculation:

$$\{(1-1)/1024\}\times 4V=0V,$$

a voltage of +0V with respect to the ramp start voltage is charged to the video line 134 corresponding to the H1 pixel. Therefore, the voltage of +0V with respect to the ramp start voltage is also charged to the H1 pixel.

Next, for example, when the video data for the pixel of H2 (H2 pixel) is 2 that is higher than 1, the SW controller 114 turns off the analog switch 133 of H2 in response to the comparator signal output from the data comparator 113 at a second clock of the CCLK. As a result, as understood from the following calculation:

$$\{(2-1)/1024\}\times 4V=0.0039V$$

a voltage of +0.0039V with respect to the ramp start voltage is charged to the video line 134 corresponding to the H2 pixel. Therefore, the voltage of +0.0039V with respect to the ramp start voltage is also charged to the H2 pixel. Thus, the gradation of the gradation pattern changes gradually. When such a gradation pattern is displayed, the 1024 analog switches 133 are sequentially turned off, so that a state where variation of load of the video lines 134 is small continues, which makes it possible to stably sample the liquid crystal drive voltage from the ramp voltage.

On the other hand, FIG. 10B shows a box pattern including a rectangular box whose gradation is 499 and its surrounding area whose gradation is 500. As described above, all the 1024 analog switches 133 are first turned on by the CRST signal, and thereby the ramp voltage (RV) 131 is supplied to all the 1024 video lines 134. Then, for example, when the video data for the pixels of H151 to H850 (H151 to H850 pixels) is 499, the SW controller 114 turns off the analog switches 133 of H151 to H850 in response to the comparator signal output from the data comparator 113 at a 499th clock of the CCLK. As a result, as understood from the following calculation:

$$\{(499-1)/1024\}\times 4V=1.945V,$$

a voltage of +1.945V with respect to the ramp start voltage is charged to the video lines 134 corresponding to the H151 to H850 pixels. Therefore, the voltage of +1.945V with respect to the ramp start voltage is also charged to the H151 to H850 pixels. However, with the turning off of the SW controller 114 of H151 to H850, 700 video lines that are more than half the 1024 video lines 134 are turned off. That is, 700/1024 of the load (capacitance of the video lines 134) connected to the ramp voltage (RV) 131 is released. As a result, a capacitance variation of approximate 700/1024 is generated.

On the other hand, for example, when the video data for the pixels of H1 to H150 and H801 to H1024 is 500, the SW controller 114 turns off the analog switches 133 of H1 to H150 and H801 to H1024 in response to the comparator signal output from the data comparator 113 at a 500th clock of the CCLK. As a result, as understood from the following calculation:

$$\{(500-1)/1024\}\times 4V=1.949V,$$

a voltage of +1.949V with respect to the ramp start voltage should be charged to the video lines 134 corresponding to the pixels of H1 to H150 and H801 to H1024.

However, due to the above-mentioned load variation, a variation of the ramp voltage is generated after the 499th clock of the CCLK as shown in FIG. 4B. Specifically, due to (a) a load variation caused by inductance, reactance or the like of the ramp voltage production circuit 300, (b) ringing generated with a load variation of an amplifier for the ramp voltage provided in the liquid crystal display panel 100 and (c) a potential difference generated by wiring resistance in the panel 100, a waveform of the ramp voltage is varied (fluctuated) as shown by a dotted line in FIG. 4B. Thus, the pixels (video lines 134) of H1 to H150 and H801 to H1024 sample the liquid crystal drive voltage while such a variation of the ramp voltage is being generated.

FIG. 4B shows a ramp voltage raised at 500th clock of the CCLK from the normal ramp voltage due to temporal load reduction at 499th clock. Performing the voltage sampling at this timing (500th clock) charges a voltage of +1.949V+α (α is a noise component voltage) with respect to the ramp start voltage to the video line 134, though the above-mentioned normal liquid crystal drive voltage of +1.949V with respect thereto should be charged to the video line 134. Therefore, the voltage of +1.949V+α with respect to the ramp start voltage is also charged to the pixel capacitor 137. In this case, as show in FIG. 10C, a higher liquid crystal drive voltage than the normal liquid crystal drive voltage is applied to the pixels of H1 to H150 and H851 to H1024, and thereby a brighter gradation than the normal gradation shown in FIG. 10B is displayed.

In addition, when the data for the pixels of H1 to H150 and H801 to H1024 is 501, as understood from the following calculation:

$$\{(501-1)/1024\}\times 4V=1.953V,$$

a voltage of +1.953V with respect to the ramp start voltage should be charged to the video lines 134 corresponding to these pixels. However, as shown in FIG. 4B, the ramp voltage temporarily raised is dropped to a voltage lower than the normal ramp voltage at a timing of a 501st clock. Thus, a voltage of +1.953V−α (α is the noise component voltage) with respect to the ramp start voltage is charged to the video line 134, though the normal liquid crystal voltage of +1.953V with respect thereto should be applied. In this case, as shown in FIG. 10D, a lower liquid crystal drive voltage than the normal liquid crystal drive voltage shown in FIG. 10B is applied to the pixels of H1 to H150 and H851 to H1024, and thereby a darker gradation than the normal gradation is displayed.

Figure 11:
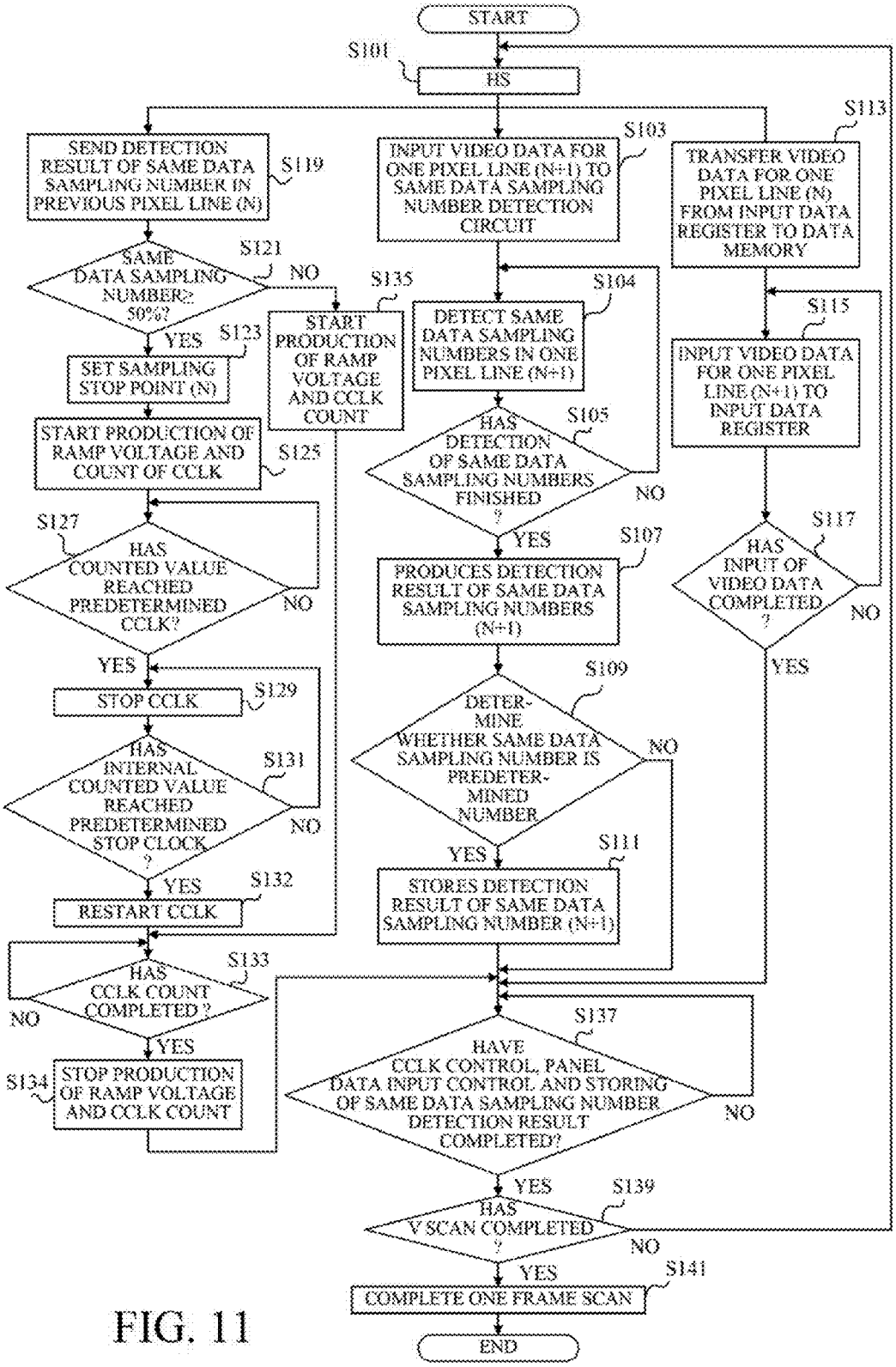
FIG. 11 is a flowchart showing operation of the electrooptical display apparatus of Embodiment 1.

In order to solve such a problem, the apparatus of this embodiment performs operation (processing) shown in FIG. 11.

The process is started in response to production, by the panel control circuit 210 at step S101, of the vertical scan start signal VS and the horizontal start signal HS and production of the video data on which the various correction processes have been performed.

At step S103, the panel control circuit 210 starts input of the video data for the N+1 pixel line (for example, when the N pixel line is a second pixel line, the N+1 pixel line is a third pixel line) to the same data sampling number detection circuit 230 from input of the horizontal start signal HS as a starting point. The input of the video data for the N+1 pixel line to the liquid crystal display panel 100 is performed simultaneously with the input of the video data to the same data sampling number detection circuit 230 at step S103. Moreover, simultaneously therewith, at step S113, the panel control circuit 210 transfers the video data stored in the input data register 111 to the data memory 112.

Figure 3:
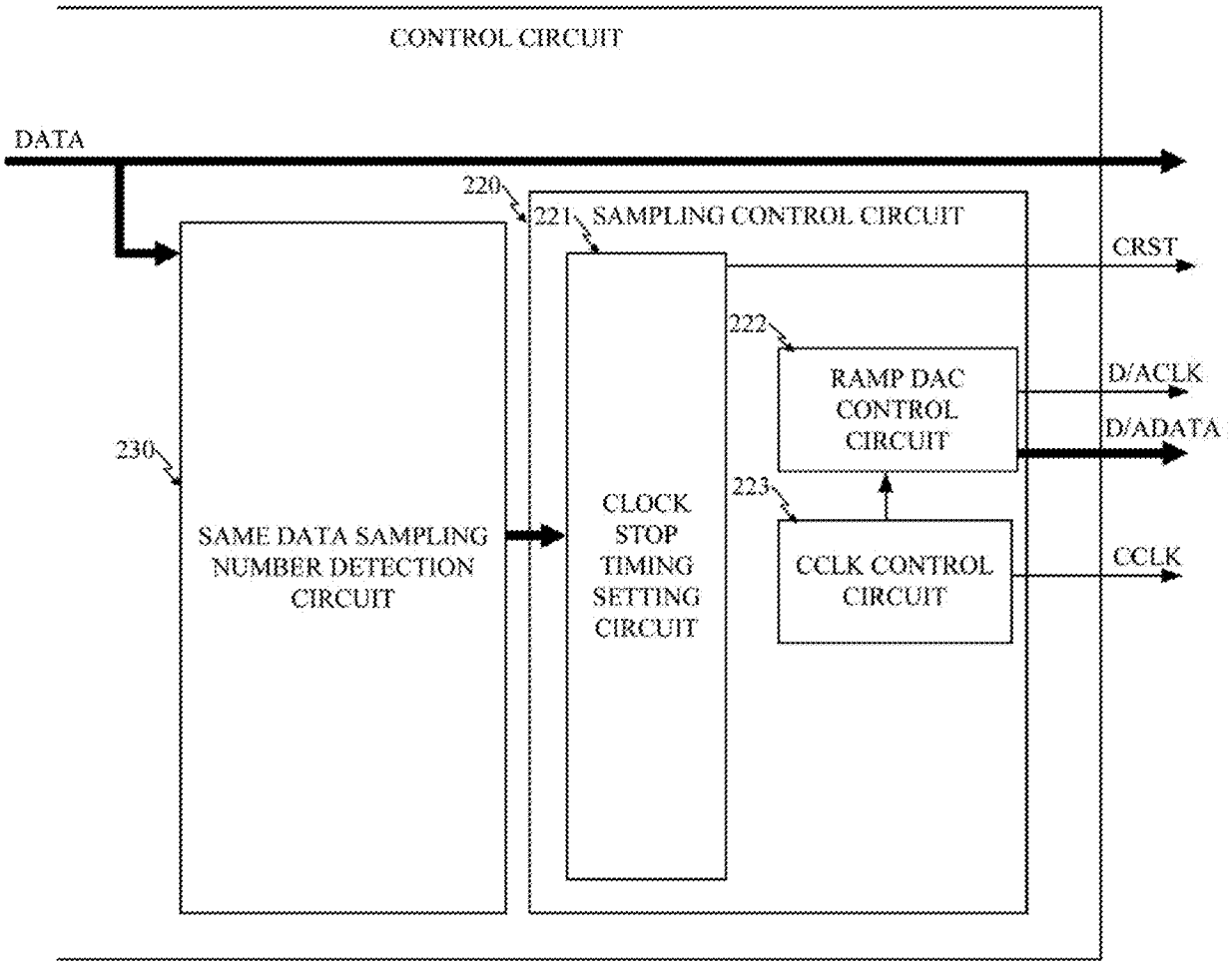
FIG. 3 is a block diagram showing a configuration of a control circuit in the electrooptical display apparatus of Embodiment 1.

Description of operation of the same data sampling number detection circuit 230 will be made here. FIG. 3 shows the same data sampling number detection circuit 230 and a configuration of the sampling control circuit 220. At step S104, the same data sampling number detection circuit 230 detects the same data sampling numbers (or same voltage sampling numbers) each showing number of pixels for which the same data of the input video data is set in 1024 pixels included in one pixel line. If the detection of the same data sampling numbers in one pixel line has finished at step S105, the same data sampling number detection circuit 230 proceeds to step S107.

Figure 5A:
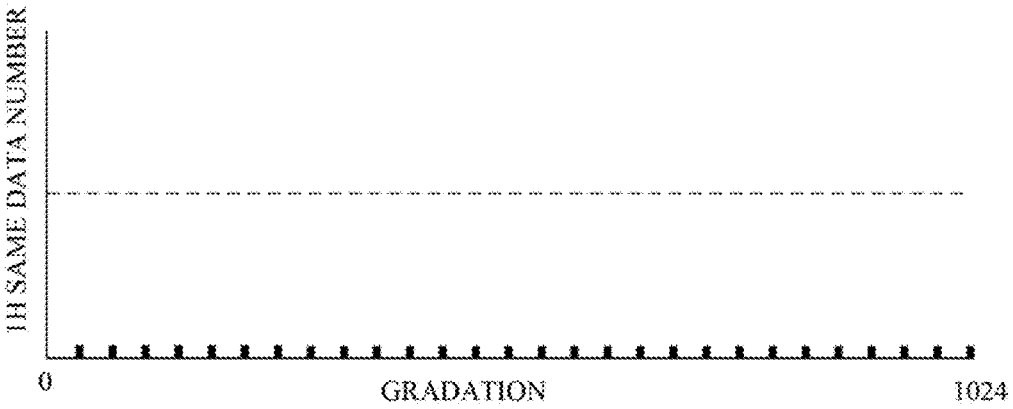
FIGS. 5A and 5B show examples of detection results of same data sampling numbers in the electrooptical display apparatus of Embodiment 1.
Figure 5B:
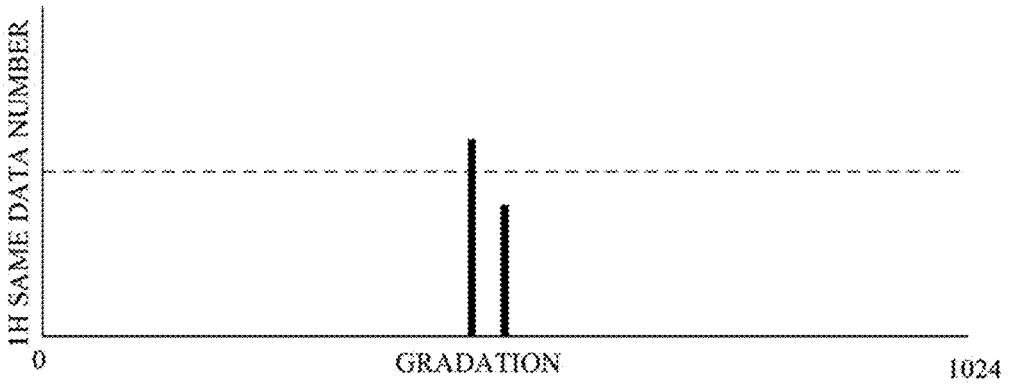

At step S107, the same data sampling number detection circuit 230 produces a histogram showing the same data sampling numbers, as shown in FIGS. 5A and 5B. In these figures, a horizontal axis shows gradations of the video data, and a vertical axis shows detected same data sampling numbers. For example, from the gradation pattern shown in FIG. 10A, the histogram shown in FIG. 5A is produced. From the box pattern shown in FIG. 10B, the histogram shown in FIG. 5B is produced.

Next, at step S109, the same data sampling number detection circuit 230 determines whether or not the detected same data sampling number is a predetermined number in one pixel line. In this embodiment, the predetermined number is 50% or more of the pixel number (sampling number) of 1024 in one pixel line. A dotted line in each of FIGS. 5A and 5B shows a sampling number corresponding to 50%.

The gradation pattern whose histogram is shown in FIG. 5A includes almost no same data, so that the same data sampling number is at most 1 or 2. That is, the histogram shown in FIG. 5A includes no same data sampling number equal to or more than 50% shown by the dotted line. In this case, the same data sampling number detection circuit 230 stores that there is no same data sampling number being the predetermined number as a detection result.

On the other hand, the box pattern whose histogram is shown in FIG. 5B includes a same data sampling number of 700 at the gradation of 499 and a same data sampling number of 324 at the gradation 500, and therefore there is a same data sampling number equal to or more than 50% ($^{700}/_{1024}$) shown by the dotted line. In this case, the same data sampling number detection circuit 230 stores at step S111 that there is such a same data sampling number being the predetermined number with that same data sampling number and the gradation at which that same data sampling number is obtained. Thus, the detection of the same data sampling number in one line is completed.

Then, after CCLK control, panel data input control and storing of the same data sampling number detection result, which will be described later, have completed at step S137, the sampling control circuit 220 at step S139 determines whether or not the V scan of the 768 pixel lines has completed. If the V scan has completed, the sampling control circuit 220 determines at step S141 that one frame scan has completed, and then ends this processing. On the other hand, if the V scan has not completed, the sampling control circuit 220 returns to step S101 to perform the above-described process on a next pixel line.

Next, description of input of the video data to the liquid crystal display panel 100 will be made. At step S113, the H drive circuit 110 in the liquid crystal display panel 100 that has received the horizontal start signal HS at step S101 transfers the video data for the N pixel line stored in the input data register 111 to the data memory 112. Then, at step S115, the H drive circuit 110 inputs the video data for the N+1 pixel line to the input data register 111. At this time, the video data for the N pixel line that has been transferred from the input data register 111 at step S113 is stored in the data memory 112. On a basis of the video data stored in the data memory 112, panel drive control described later is performed.

Next, at step S117, the H drive circuit 110 determines whether or not the input of the video data for the N+1 pixel line (for 1024 pixels) to the input data register 111 has completed. If that input has not completed, the H drive circuit 110 returns to step S115 to repeat the process thereat until that input is completed. If that input has completed, the H drive circuit 110 proceeds to step S137.

Next, description of the sampling control circuit 220 and the panel drive control will be made. As described above, at step S103, the panel control circuit 220 starts the input of the video data for the N+1 pixel line to the same data sampling number detection circuit 230 from the horizontal start signal HS (step S101).

In parallel therewith, at step S119, the same data sampling number detection circuit 230 sends, to a clock stop timing setting circuit 221 in the sampling control circuit 220, the detection result of the same data sampling number in a previous video data input pixel line (N pixel line) to the current video data input pixel line (N+1 pixel line). The detection result has been stored by the same data sampling number detection circuit 230 at step S111.

Then, at step S121, the clock stop timing setting circuit 221 determines whether or not the detection result sent from the same data sampling number detection circuit 230 shows that the same data sampling number is the predetermined number (50% or more). If the detection result does not show that the same data sampling number is the predetermined number, the sampling control circuit 220 proceeds to step S135.

At step S135, the sampling control circuit 220 causes a RampDAC control circuit 222 to output the data D/ADATA that monotonously increments with the clock number of the D/ACLK such that the ramp voltage shown in FIG. 4A may be output.

Moreover, simultaneously therewith, a CCLK control circuit 223 starts output (count) of the CCLK to the data comparator 113 in the H drive circuit 110. Then, the sampling control circuit 220 causes the ramp voltage production circuit 300 to produce the ramp voltage, and causes the liquid crystal display panel 100 to charge the liquid crystal drive voltage to the pixel capacitors 137 in one pixel line (1024 pixels).

The charge (voltage sampling) control of the liquid crystal drive voltage is performed by production of the ramp voltage with a resolution of 10 bits (that is, 1024 gradations) in the ramp voltage production circuit 300 and by control of the data memory 112, the data comparator 113, the SW controller 114 and the analog switches 133. Next, at step S113, in response to reaching of a counted value of the CCLK to a predetermined value (1024 or more corresponding to the gradation numbers), the sampling control circuit 220 detects completion of the voltage sampling for the pixel capacitors 137. Then, at step S134, the sampling control circuit 220 stops the production of the ramp voltage and the count of the CCLK, and thereafter proceeds to step S137.

On the other hand, if the detection result shows that the detection result of the same data sampling number is the predetermined number at step S121, the sampling control circuit 220 proceeds to step S123. In this case, the ramp voltage may include the noise as shown in FIG. 4B. Thus, at step S123, the clock stop timing setting circuit 221 sets, depending on the detection result of the same data sampling number, a stop timing (stop point) for the RampDAC control circuit 222 and the CCLK control circuit 223.

In the case of displaying the box pattern shown in FIG. 10B in which the gradation in the box is 499 and the gradation in the surrounding area is 500, for the gradation of 500, the ramp voltage including the noise component voltage is applied to the pixel capacitors 137 as described above. Therefore, the sampling control circuit 220 temporarily stops the sampling (in other words, performs temporal stop control of the sampling) from a time point at which the sampling for the gradation of 499 is finished. That is, the sampling control circuit 220 sets the gradation of 499 as a temporal sampling stop point.

Next, at step S125, the sampling control circuit 220 causes the RampDAC control circuit 222 to output the data D/ADATA that monotonously increments with the clock number of the D/ACLK such that the ramp voltage shown in FIG. 4C may be output. Moreover, simultaneously therewith, the CCLK control circuit 223 starts the output (count) of the CCLK to the data comparator 113 in the H drive circuit 110. Then, the sampling control circuit 220 causes the ramp voltage production circuit 300 to produce the ramp voltage, and causes the liquid crystal display panel 100 to charge the liquid crystal drive voltage to the pixel capacitors 137 in one pixel line (1024 pixels).

Then, at step S127, the sampling control circuit 220 determines whether or not the counted value of the CCLK has reached a count value (predetermined clock) corresponding to the stop point of the sampling set at step S123. If the counted value has not reached the count value corresponding to the stop point, the sampling control circuit 220 repeats this determination until the counted value reaches the count value corresponding to the stop point. On the other hand, if the counted value has reached the count value corresponding to the stop point, the sampling control circuit 220 proceeds to step S129 to cause the RampDAC control circuit 222 to stop the output of the D/ACLK and the increment of the D/ADATA. Furthermore, the sampling control circuit 220 causes the CCLK control circuit 223 to stop the output of the CCLK to the liquid crystal display panel 100.

Thereafter, at step S131, the sampling control circuit 220 determines whether or not a counted value of an internal CCLK counted by the CCLK control circuit 223 has reached a count value corresponding to a predetermined stop clock. If this counted value has not reached the count value corresponding to the predetermined stop clock, the sampling control circuit 220 repeats this determination until the counted value reaches the count value corresponding to the predetermined stop clock. If the counted value has reached the count value (restart point) corresponding to the predetermined stop clock, the sampling control circuit 220 proceeds to step S132 to restart the output of the D/ACLK, the increment of the D/ADATA and the output of the CCLK which have been previously stopped.

The sampling control circuit 220 thus stops the monotonous increase of the ramp voltage produced by the ramp voltage production circuit 300 for a period (stop period) from the stop point to the restart point shown in FIG. 4C. In addition, the sampling control circuit 220 stops, by stopping the output of the CCLK, the charge of the liquid crystal drive voltage (that is, the voltage sampling) to the pixel capacitors 137 of the liquid crystal display panel 100.

The predetermined stop clock is set to a period of time for which the ringing of the ramp voltage due to the load variation can be settled down. For example, the predetermined stop clock may be set to 10 clocks of the CCLK. Such stopping of the monotonous increase of the ramp voltage with the stopping of the voltage sampling to the pixel capacitors 137 enables prevention of display of a gradation different from the normal gradation that should be displayed, as shown in FIGS. 10C and 10D, by influence of the ringing of the ramp voltage due to the load variation.

After the output of the CCLK is restarted at step S132, the sampling control circuit 220 proceeds to step S137 via the above-mentioned steps S133 and S134.

As described above, in the case where the noise such as the ringing due to the load variation maybe generated in the ramp voltage to be supplied to the video lines 134, this embodiment temporarily stops the monotonous increase of the ramp voltage and the voltage sampling therefrom for the period of time (noise settling period) where the noise can be regarded as being settled. Thereby, this embodiment can perform the voltage sampling to the pixels from the ramp voltage including almost no noise, which enables prevention of deterioration of image display quality.

Although this embodiment described the case where "the predetermined number" in the determination whether or not the same data sampling number is the predetermined number is 50% or more, this "50% or more" is merely one example, and the predetermined number may be set to other numbers (for example, 30% or 70%) according to a level of the noise such as the ringing that influences the voltage sampling. In addition, the stop period of the monotonous change of the ramp voltage and the voltage sampling to the pixels may be changed according to the noise settling period.

Furthermore, the monotonous change of the ramp voltage may be stopped by stopping the increment of the D/ADATA (that is, by setting the D/ADATA to data for making the ramp voltage constant), without stopping the output of the D/ACLK.

Moreover, although this embodiment described the case of performing the stop control of the monotonous change of the ramp voltage and the voltage sampling to the pixels only once for the detection that the same data sampling number is the predetermined number, the stop control may be performed multiple times according to a situation of presence of the same data sampling number. Alternatively, without performing the stop control, a frequency of the voltage sampling may be lowered so as to perform the voltage sampling without sampling the noise in the ramp voltage.

Moreover, the ramp voltage may be monotonously decreased. Furthermore, the ramp voltage is not necessarily required to be linearly monotonously changed, and may be non-linearly monotonously changed according to predetermined data such as table data.

In addition, the voltage sampling to the pixels may be stopped, not by stopping the output of the CCLK, but by, for example, outputting a signal for disabling the CCLK to the liquid crystal display panel 100 to invalidate the clock for the data comparator 113.

Furthermore, the resolution of the liquid crystal display panel and the numbers of the scan lines and data lines (video lines) thereof described in this embodiment are merely examples, and other resolutions and numbers thereof may be employed. Moreover, any input form (such as parallel, cereal and data bit number) of the video data can be employed.

Embodiment 2

Next, description will be made of an electrooptical display apparatus that is a second embodiment (Embodiment 2) of the present invention with reference to FIGS. 6 and 7.

Figure 6:
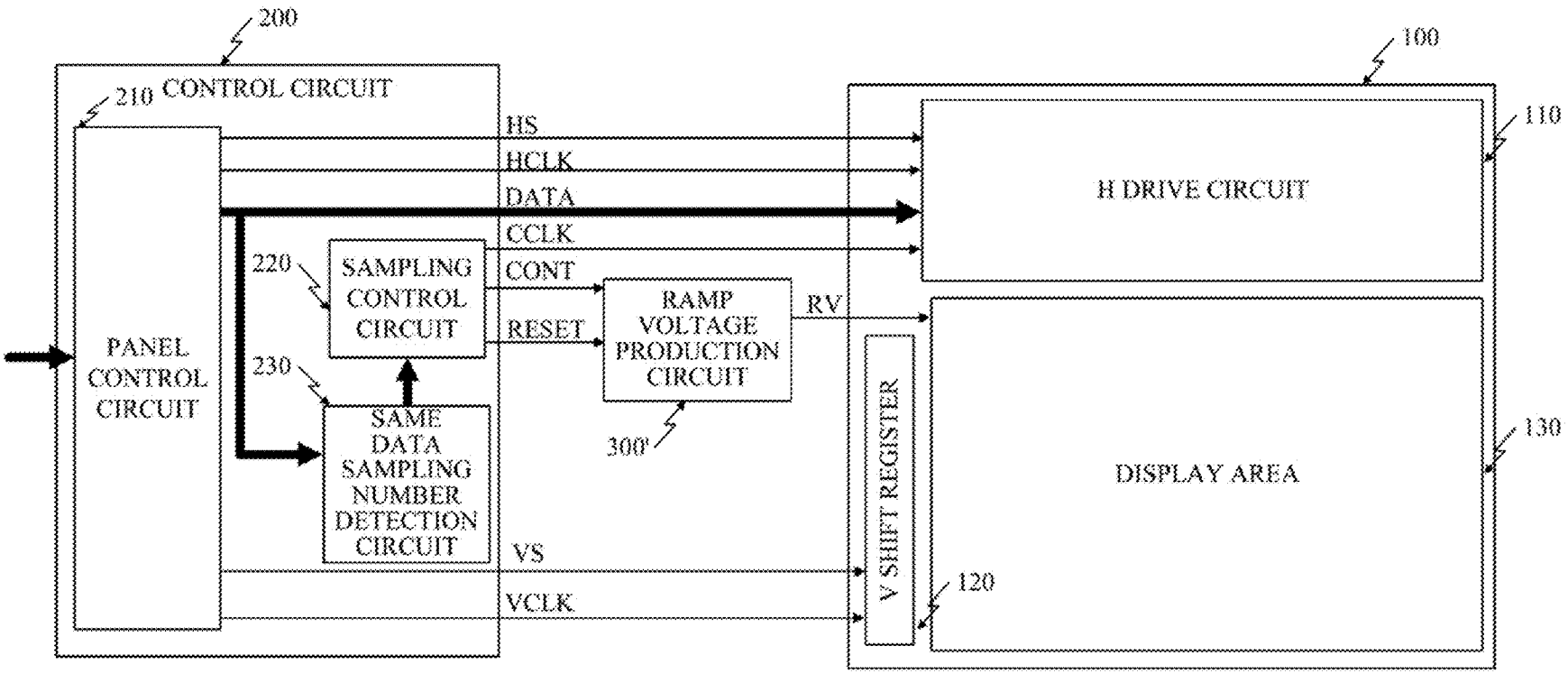
FIG. 6 is a block diagram showing a configuration of an electrooptical display apparatus that is Embodiment 2 of the present invention.

FIG. 6 shows a configuration of the electrooptical display apparatus of Embodiment 2. This electrooptical display apparatus includes, as same or similar components as or to those in Embodiment 1, the panel control circuit 210, the same data sampling number detection circuit 230 and the sampling control circuit 220 in the control circuit 200 and the liquid crystal display panel 100. However, a ramp voltage production circuit 300' in this embodiment is constituted by a circuit shown in FIG. 7, which is different from the D/A converter described in Embodiment 1.

The ramp voltage production circuit 300' in this embodiment includes a constant current source 301 whose one end is connected to a power source and another end is connected to a charging capacitor 302. The ramp voltage production circuit 300' charges the charging capacitor 302 by an electric current from the constant current source 301, and produces a ramp voltage RV by using the charged electric charge. Turning on and off of the constant current source 301 is controlled by a CONT signal received from the sampling control circuit 220. Both Ends of the charging capacitor 302 are connected to a drain and a source of a transistor 303. The ramp voltage production circuit 300' produces the ramp voltage RV by causing the charging capacitor 302 to discharge in response to input of a RESET signal from the sampling control circuit 220 to a gate of the transistor 303.

Although the configuration of the ramp voltage production circuit 300' is different from that in Embodiment 1, operation (processing) performed by the apparatus is basically the same as that shown by the flowchart of FIG. 11. However, this embodiment is different in that the CONT and RESET signals are output from the sampling control circuit 220 as described above and the apparatus operates according to these signals. The following description will be mainly made of the different points from Embodiment 1 with reference to FIG. 11.

At step S121, the clock stop timing setting circuit 221 proceeds to step S135 when determining that there is no detection result showing that the same data sampling number is the predetermined number (50% or more), as well as in Embodiment 1.

At step S135, the sampling control circuit 220 sets the RESET signal to Hi such that the ramp voltage shown in FIG. 4A may be output. This setting of the RESET signal turns the transistor 303 shown in FIG. 7 on, and thereby causes the charging capacitor 302 to discharge. Thereafter, the sampling control circuit 220 sets the RESET signal to Lo and outputs the CONT signal to turn the constant current source 301 on (that is, to activate the constant current source 301). This activation of the constant current source 301 starts production of the ramp voltage.

With this start of the production of the ramp voltage, the CCLK control circuit 223 shown in FIG. 3 starts the output (count) of the clock CCLK to the data comparator 113 in the H drive circuit 110, as well as in Embodiment 1. Then, the sampling control circuit 220 performs the above-described production of the ramp voltage and the charge of the liquid crystal drive voltage to the pixel capacitors 137 in one line (1024 pixels) of the liquid crystal display panel 100.

On the other hand, at step S121, the clock stop timing setting circuit 221 proceeds to step S123 when determining that there is the detection result showing that the same data sampling number is the predetermined number (50% or more). In this determination, the ramp voltage may include the noise as shown in FIG. 4B. Therefore, at step S123, the clock stop timing setting circuit 221 outputs the CONT signal for controlling the turning on and off of the constant current source 301, depending on the detection result of the same data sampling number. Moreover, the clock stop timing setting circuit 221 sets, as well as in Embodiment 1, the stop timing control point (stop point) of the CCLK control circuit 223.

Figure 7:
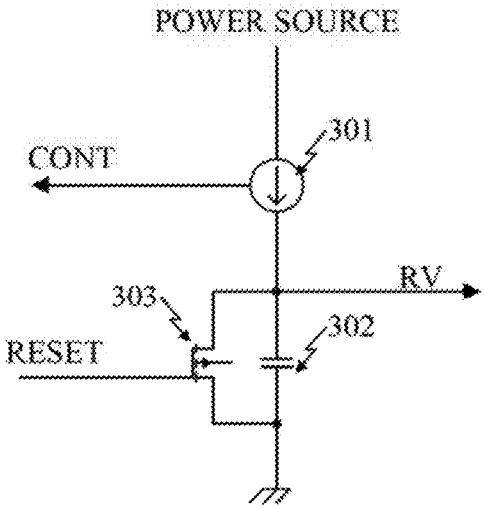
FIG. 7 showing a configuration of a ramp voltage producing circuit in the electrooptical display apparatus of Embodiment 2.

Next, at step S125, the sampling control circuit 220 shown in FIG. 6 sets the RESET signal to Hi to turn the transistor 303 shown in FIG. 7 on for causing the charging capacitor 302 to discharge such that the ramp voltage shown in FIG. 4C may be output. Thereafter, the sampling control circuit 220 sets the RESET signal to Lo and outputs the CONT signal to turn the constant current source 301 on (that is, to activate the constant current source 301). This activation of the constant current source 301 starts production of the ramp voltage. With this start of the production of the ramp voltage, the CCLK control circuit 223 starts the output (count) of the CCLK to the data comparator 113 in the H drive circuit 110. Then, the sampling control circuit 220 performs the above-described production of the ramp voltage and the charge of the liquid crystal drive voltage to the pixel capacitors 137 in one line (1024 pixels) of the liquid crystal display panel 100.

At step S127, the sampling control circuit 220 determines whether or not the counted value of the CCLK has reached a count value (predetermined clock) corresponding to the stop point of the voltage sampling set at step S123. If the counted value has reached the count value corresponding to the stop point, the sampling control circuit 220 proceeds to step S129 to output the CONT signal as a constant current stop signal to the constant current source 301 so as to stop the monotonous increase of the ramp voltage.

Moreover, at step S129, the sampling control circuit 220 causes the CCLK control circuit 223 to stop the output of the CCLK to the liquid crystal display panel 100.

Thereafter, at step S131, the sampling control circuit 220 determines whether or not a counted value of an internal CCLK counted by the CCLK control circuit 223 has reached a count value corresponding to a predetermined stop clock. The predetermined stop clock is set as well as in Embodiment 1. If the counted value has reached the count value (restart point) corresponding to the predetermined stop clock, the sampling control circuit 220 proceeds to step S132 to switch the CONT signal from a previous state to deactivate the constant current source 301 to a state to activate it, and restarts the output of the CCLK.

The sampling control circuit 220 thus stops the monotonous increase of the ramp voltage produced by the ramp voltage production circuit 300' for a period (stop period) from the stop point to the restart point shown in FIG. 4C. In addition, the sampling control circuit 220 stops, by stopping the output of the CCLK, the charge of the liquid crystal drive voltage (that is, the voltage sampling) to the pixel capacitors 137 of the liquid crystal display panel 100. Subsequent operation is same as that of Embodiment 1.

The configuration of the ramp voltage production circuit 300' described in this embodiment is merely an example, and any configuration may be employed as long as it can produce the ramp voltage and can temporarily stop increase (or decrease) of the ramp voltage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-250453, filed on Nov. 16, 2011, which is hereby incorporated by reference herein in its entirety.

What is claimed is:

1. An electrooptical display apparatus including a plurality of pixels, the apparatus comprising:

scan lines and data lines arranged in a matrix;

pixel switching elements each configured to enable, in response to application of a selection voltage to one of the scan lines, application of a pixel voltage to one pixel included in a pixel row corresponding to the one scan line through one of the data lines;

a voltage producing part configured to produce a sampling voltage that is allowed to be supplied to the data lines and that monotonously changes in a period of time where the selection voltage is applied to the scan line;

a voltage sampling part configured to sample the pixel voltage from the sampling voltage with a configuration including (a) a scan line drive circuit to apply the selection voltage to a sequentially selected one of the scan lines and (b) data line switches to switch on and off of supply of the sampling voltage to the data lines;

a sampling number detecting part configured to detect a same voltage sampling number that is a number of pixels, in one pixel line, for which a same voltage is sampled as the pixel voltage by the voltage sampling part; and a controller configured to lower a frequency of sampling of the pixel voltage in a case where the same voltage sampling number detected by the sampling number detecting part is greater than or equal to a predetermined number.

2. The electrooptical display apparatus according to claim 1, wherein the controller is configured to stop the sampling of the pixel voltage by stopping supply of a sampling clock to the voltage sampling part or by disabling the sampling clock.

3. The electrooptical display apparatus according to claim 1, wherein the voltage producing part is constituted by a D/A converter to convert digital data to analog data, and wherein the controller is configured to stop the monotonous change of the sampling voltage by stopping a clock for performing data update of the D/A converter or by providing, as the digital data, data for making the sampling voltage constant.

4. The electrooptical display apparatus according to claim 1, wherein the voltage producing part is constituted by a constant current source and a capacitor to charge a current from the constant current source, and wherein the controller is configured to stop the monotonous change of the sampling voltage by stopping output of the current from the constant current source.

5. An electronic device comprising:

a body of the device; and an electrooptical display apparatus attached to the body and including a plurality of pixels, wherein the electrooptical display apparatus includes:

scan lines and data lines arranged in a matrix;

pixel switching elements each configured to enable, in response to application of a selection voltage to one of the scan lines, application of a pixel voltage to one pixel included in a pixel row corresponding to the one scan line through one of the data lines;

a voltage producing part configured to produce a sampling voltage that is allowed to be supplied to the data lines and that monotonously changes in a period of time where the selection voltage is applied to the scan line;

a voltage sampling part configured to sample the pixel voltage from the sampling voltage with a configuration including (a) a scan line drive circuit to apply the selection voltage to a sequentially selected one of the scan lines and (b) data line switches to switch on and off of supply of the sampling voltage to the data lines;

a sampling number detecting part configured to detect a same voltage sampling number that is a number of pixels, in one pixel line, for which a same voltage is sampled as the pixel voltage by the voltage sampling part; and a controller configured to lower a frequency of sampling of the pixel voltage in a case where the same voltage sampling number detected by the sampling number detecting part is greater than or equal to a predetermined number.

6. An electrooptical display apparatus including a plurality of pixels, the apparatus comprising:

scan lines and data lines arranged in a matrix;

pixel switching elements each configured to enable, in response to application of a selection voltage to one of the scan lines, application of a pixel voltage to one pixel included in a pixel row corresponding to the one scan line through one of the data lines;

a voltage producing part configured to produce a sampling voltage that is allowed to be supplied to the data lines and that monotonously changes in a period of time where the selection voltage is applied to the scan line;

a voltage sampling part configured to sample the pixel voltage from the sampling voltage with a configuration including (a) a scan line drive circuit to apply the selection voltage to a sequentially selected one of the scan lines and (b) data line switches to switch on and off of supply of the sampling voltage to the data lines;

a sampling number detecting part configured to detect a same voltage sampling number that is a number of pixels, in one pixel line, for which a same voltage is sampled as the pixel voltage by the voltage sampling part; and a controller configured to temporarily stop the sampling of the pixel voltage and to stop the monotonous change of the sampling voltage produced by the voltage producing part, in the case where the same voltage sampling number detected by the sampling number detecting part is greater than or equal to the predetermined number.

7. The electrooptical display apparatus according to claim 6, wherein the controller is configured to stop the sampling of the pixel voltage by stopping supply of a sampling clock to the voltage sampling part or by disabling the sampling clock.

8. The electrooptical display apparatus according to claim 6, wherein the voltage producing part is constituted by a D/A converter to convert digital data to analog data, and wherein the controller is configured to stop the monotonous change of the sampling voltage by stopping a clock for performing data update of the D/A converter or by providing, as the digital data, data for making the sampling voltage constant.

9. The electrooptical display apparatus according to claim 6, wherein the voltage producing part is constituted by a constant current source and a capacitor to charge a current from the constant current source, and wherein the controller is configured to stop the monotonous change of the sampling voltage by stopping output of the current from the constant current source.

* * * * *